US005984689A

United States Patent [19]

Dong

[11] Patent Number: 5,984,689

[45] Date of Patent: Nov. 16, 1999

[54] CARD CONNECTOR HAVING A PICK-UP MEMBER

[75] Inventor: Shun-Chi Dong, Tu-Chen, Taiwan

[73] Assignee: Hon Hai Precision Ind. Co., Ltd., Taipei Hsien, Taiwan

[21] Appl. No.: 09/218,722

[22] Filed: Dec. 22, 1998

[30] Foreign Application Priority Data

Dec. 31, 1997 [TW] Taiwan ..... 86221865

[51] Int. Cl.[6] ..... H01R 9/09

[52] U.S. Cl. ..... 439/64; 439/940

[58] Field of Search ..... 439/64, 377, 940, 439/135

[56] References Cited

U.S. PATENT DOCUMENTS 5,055,971 10/1991 Fudala et al. ..... 174/35 R 5,154,631 10/1992 Belanger, Jr. ..... 439/64

5,249,977 10/1993 Tamaka et al. ..... 439/135

5,511,986 4/1996 Casey et al. ..... 439/188

*Primary Examiner*—Neil Abrams

*Assistant Examiner*—J. F. Duverne

[57] ABSTRACT

A card connector housing comprises an elongate insulative housing having two guiding bars extending from distal ends thereof for guiding a complementary card inserted into the housing. A plurality of contacts are received in the housing for electrically engaging with the inserted card. An auxiliary suction member extends from an upper surface of the housing thereby defining an engagement region between the auxiliary suction member and the housing. The auxiliary suction member provides a flat surface for receiving suction from a vacuum nozzle during automated soldering. The auxiliary suction member can be manually separated from the housing after the automated soldering.

2 Claims, 6 Drawing Sheets

CARD CONNECTOR HAVING A PICK-UP MEMBER

BACKGROUND OF THE INVENTION

1. Field of the Invention

The present invention relates to a card connector and particularly to a card connector having a pick-up member for receiving suction from a vacuum nozzle for positioning it onto a printed circuit board.

2. The Prior Art

Memory cards have become popular due to the trend of compact size, modularization, and object oriented requirements of the computer industry. Accordingly, card connectors have also become more popular because they are the inevitable members cooperating with the memory cards. However, soldering of a card connector to a printed circuit board is difficult due to the card connector not having a sufficient flat surface for a vacuum nozzle to be fixed to the card connector. U.S. Pat. Nos. 4,396,245, 5,026,295, 5,055,971, 5,147,209, 5,242,311, and 5,249,977 disclose different auxiliary suction members for use with different connectors. For example, FIG. 6 illustrates a conventional card connector 4 constructed according to card bus standards to have an insulative housing 40 and a mating face 41 defined in one side of the housing 40. Normally, the card bus connector 4 is manually positioned on a printed circuit board and soldered thereto. However, manually positioning the connector 4 on the printed circuit board instead of using a vacuum nozzle is cost inefficient. For facilitating operation of a vacuum nozzle in automated soldering, a card connector 5 as shown in FIG. 7 includes an auxiliary suction member 51 having a flat surface integrated with two guiding bars 50 thereof for receiving suction from a vacuum nozzle during automated soldering. The auxiliary suction member 51 can be withdrawn from the connector 5 after the connector 5 has been soldered on a related printed circuit board. Although the auxiliary suction member 51 is useful for the soldering of the card connector, the manufacture thereof results in a considerable extra cost. In addition, the auxiliary suction member 51 occupies too much space which violates the compact size requirement of personal computers. Moreover, the auxiliary suction member 51 is not detachable from the housing therefore it will occupy space even after the connector 5 has been soldered on the printed circuit board. Hence, it is requisite to provide a space sufficient auxiliary suction member for receiving suction from a vacuum nozzle whereby a card connector can be positioned on a PCB with minimum cost.

SUMMARY OF THE INVENTION

The primary purpose of the present invention is to provide a card connector having an auxiliary suction member for receiving suction from a vacuum nozzle during an automated soldering procedure in which the connector is picked up by the vacuum nozzle and soldered onto a printed circuit board.

In accordance with one aspect of the present invention, a card connector housing comprises an elongate insulative housing having two guiding bars extending from distal ends thereof for guiding a complementary card inserted into the housing. A plurality of contacts are received in the housing for electrically engaging with the inserted card. An auxiliary suction member extends from an upper surface of the housing thus defining an engagement region between the auxiliary suction member and the housing. The auxiliary suction member provides a flat surface for receiving suction from a vacuum nozzle during automated soldering.

These and additional objects, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1:
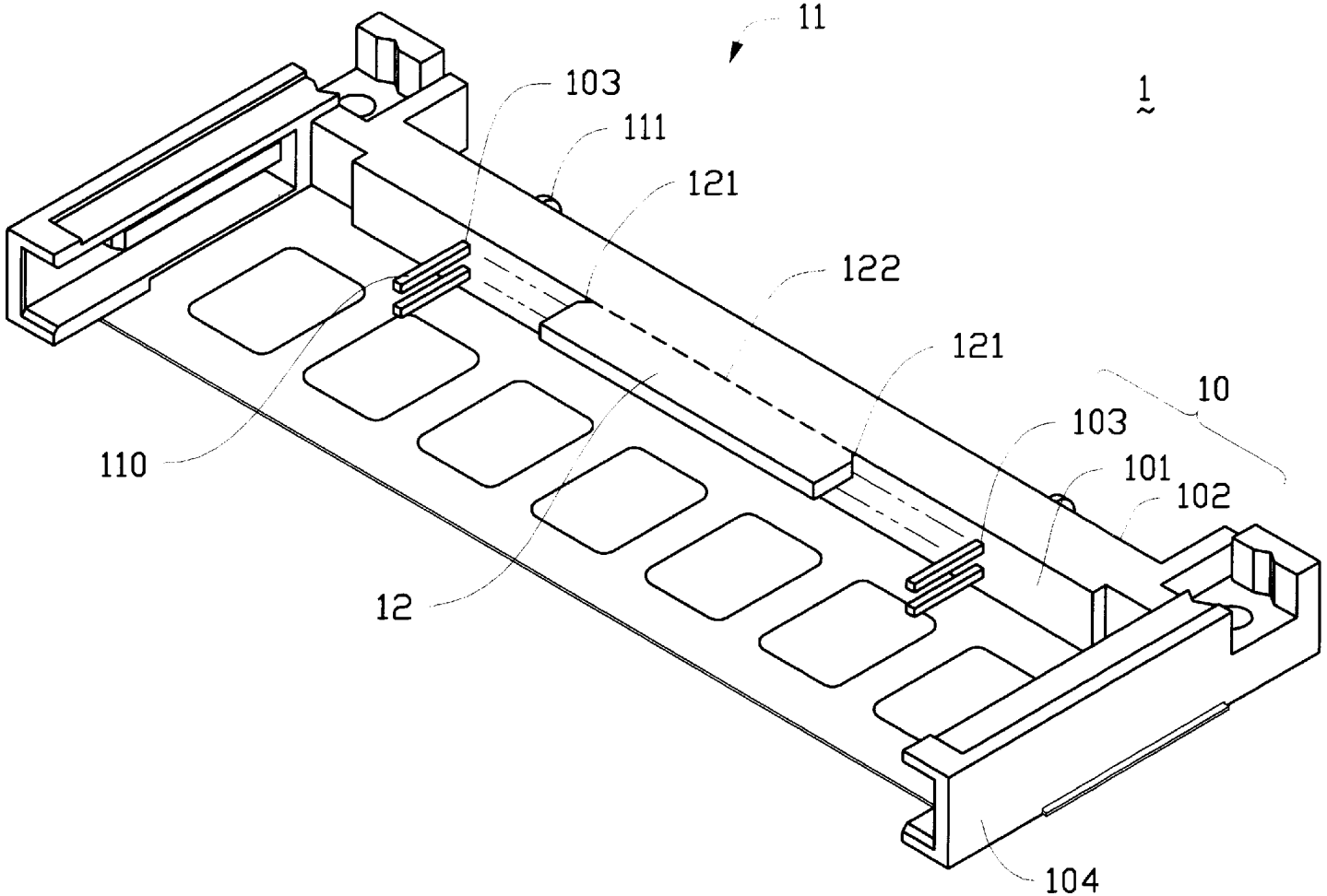
FIG. 1 is a perspective view of a card bus housing in accordance with the present invention.

Referring to FIG. 1, a card connector housing 1 in accordance with the present invention comprises an insulative housing 10 having two guiding bars 104 extending from distal ends thereof, a plurality of contacts 11 received in the housing 10, and an auxiliary suction member 12 extending from an upper surface of the housing 10 thereby defining an engagement region between the housing 10 and the auxiliary suction member 12. The housing 10 has a mating face 101 for matingly engaging with a complementary card (not shown) and a soldering face 102 from which the contacts 11 extend in a right angled manner for surface mounting on a printed circuit board (not shown). A plurality of passageways 103 are defined between the mating face 101 and the soldering face 102 for receiving the contacts 11. Each contact 11 has an engaging portion (not shown) interferentially retained in the passageway 103, a soldering portion 111 having a right angled shape (not completely shown) to be soldered on the printed circuit board and a mating portion 110 extending from the mating face 101 of the housing 10 for electrically engaging with the card.

The auxiliary suction member 12 is a plate having a flat surface and detachably connected to the housing 10 via a line of grooves 122 defined in the engagement region between the housing 10 and the auxiliary suction member 12. Two cutouts 121 are respectively defined at two ends of the grooved line 122 for facilitating detachment of the auxiliary suction member 12 from the housing 10. With the provision of the line of grooves 122 and the two cutouts 121, the auxiliary suction member 12 can be easily separated from the housing 10 after the housing 10 has been soldered onto the printed circuit board. The auxiliary suction member 12 in this embodiment extends from an intermediate portion of an upper surface of the housing 10. However, the auxiliary suction member 12 may extend from other portions of the upper surface of the housing 10, for example from the rear or side portions of the upper surface of the housing 10.

Figure 2:
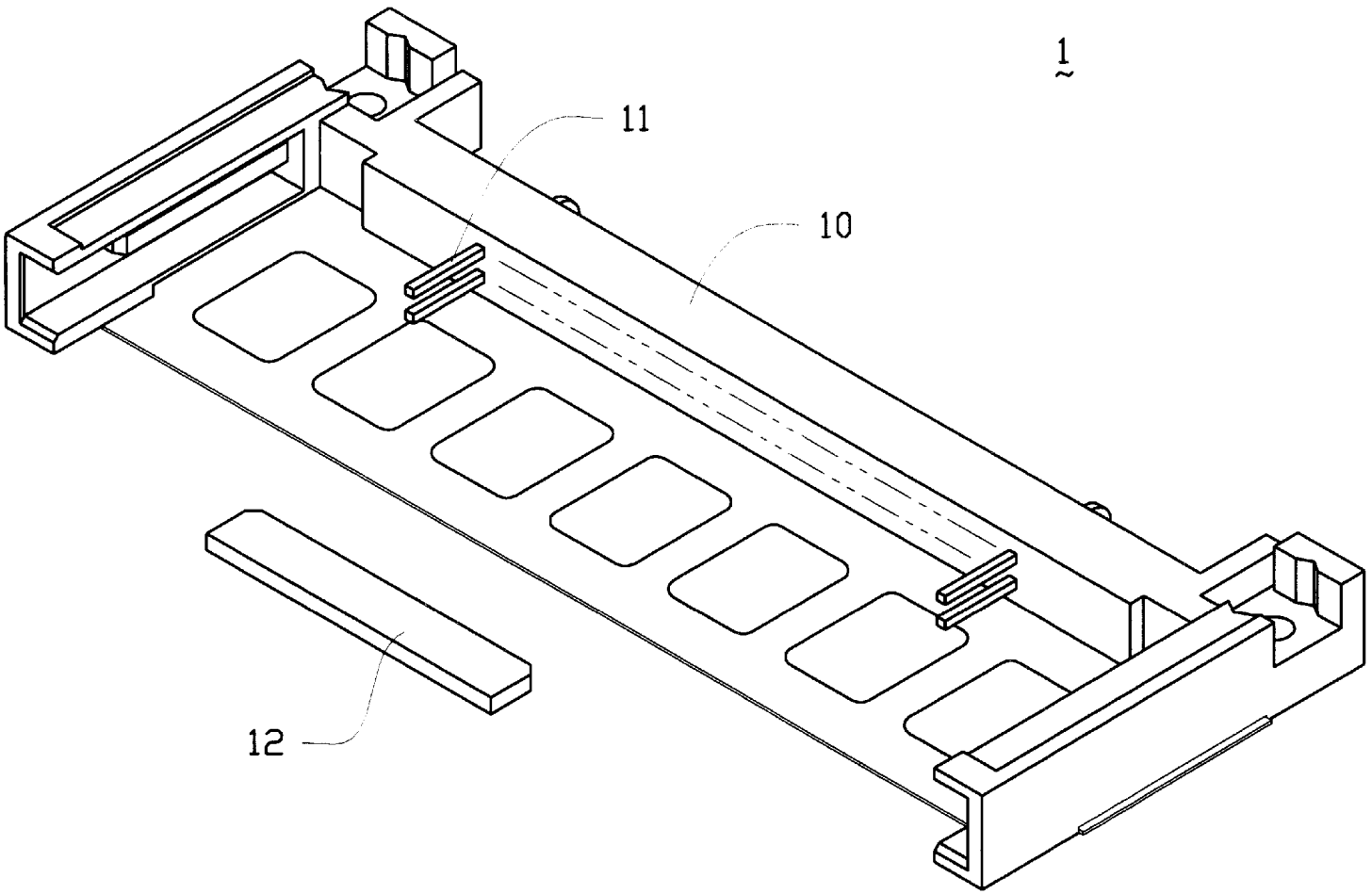
FIG. 2 illustrates the card bus housing of FIG. 1, wherein an auxiliary suction member thereof is separated from the housing.
Figure 3:
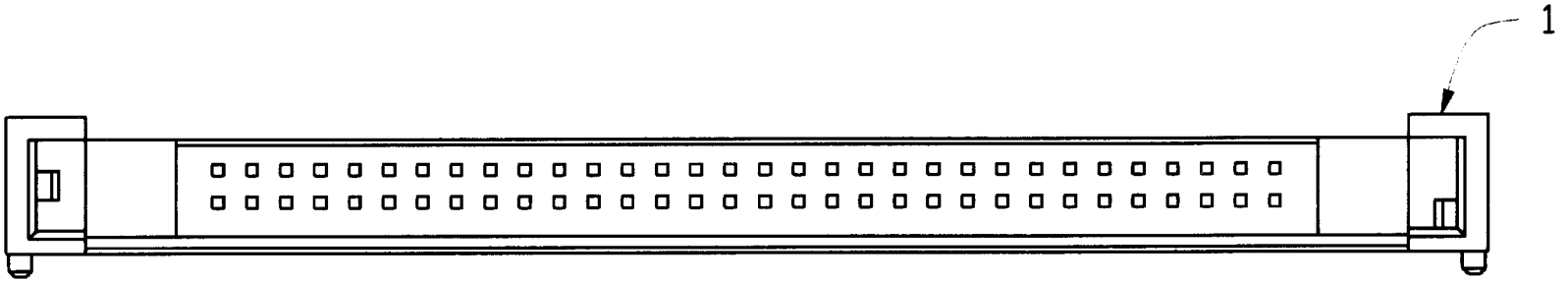
FIG. 3 is a front view of the card bus housing of FIG. 1.
Figure 4:
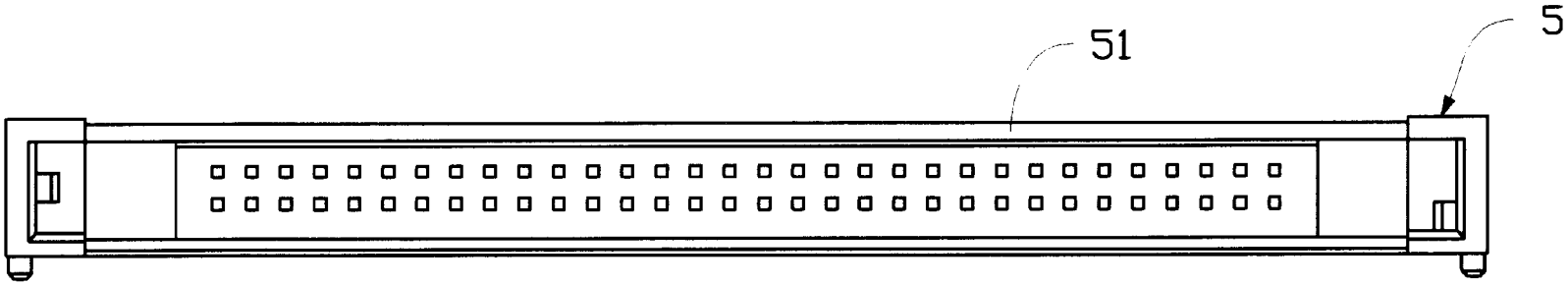
FIG.4 (PRIOR ART)
FIG. 4 is a front view of a conventional card bus housing.

Referring to FIG. 2, the auxiliary suction member 12 is separated from the housing 10 after the latter has been soldered to the printed circuit board. FIG. 3 illustrates a front view of the present invention 1 in which the auxiliary suction member 12 has been separated therefrom. FIG. 4 illustrates a front view of the conventional card connector housing 5. From FIGS. 4 and 5, it is clear that the size of the card connector housing of the present invention is smaller than that of the conventional card connector.

Figure 5:
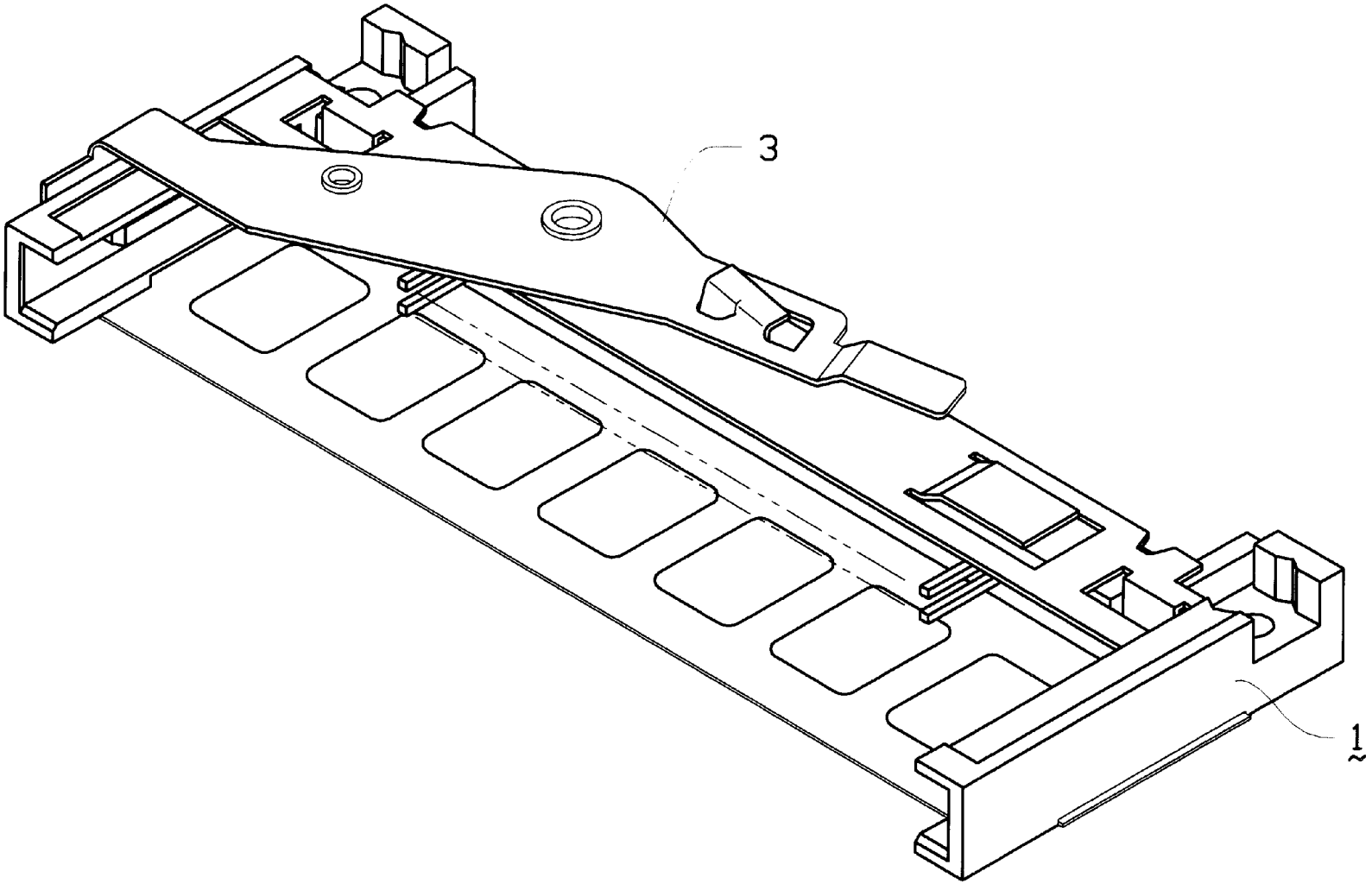
FIG. 5 illustrates the addition of an ejector mechanism to the card bus housing of FIG. 2.
Figure 6:
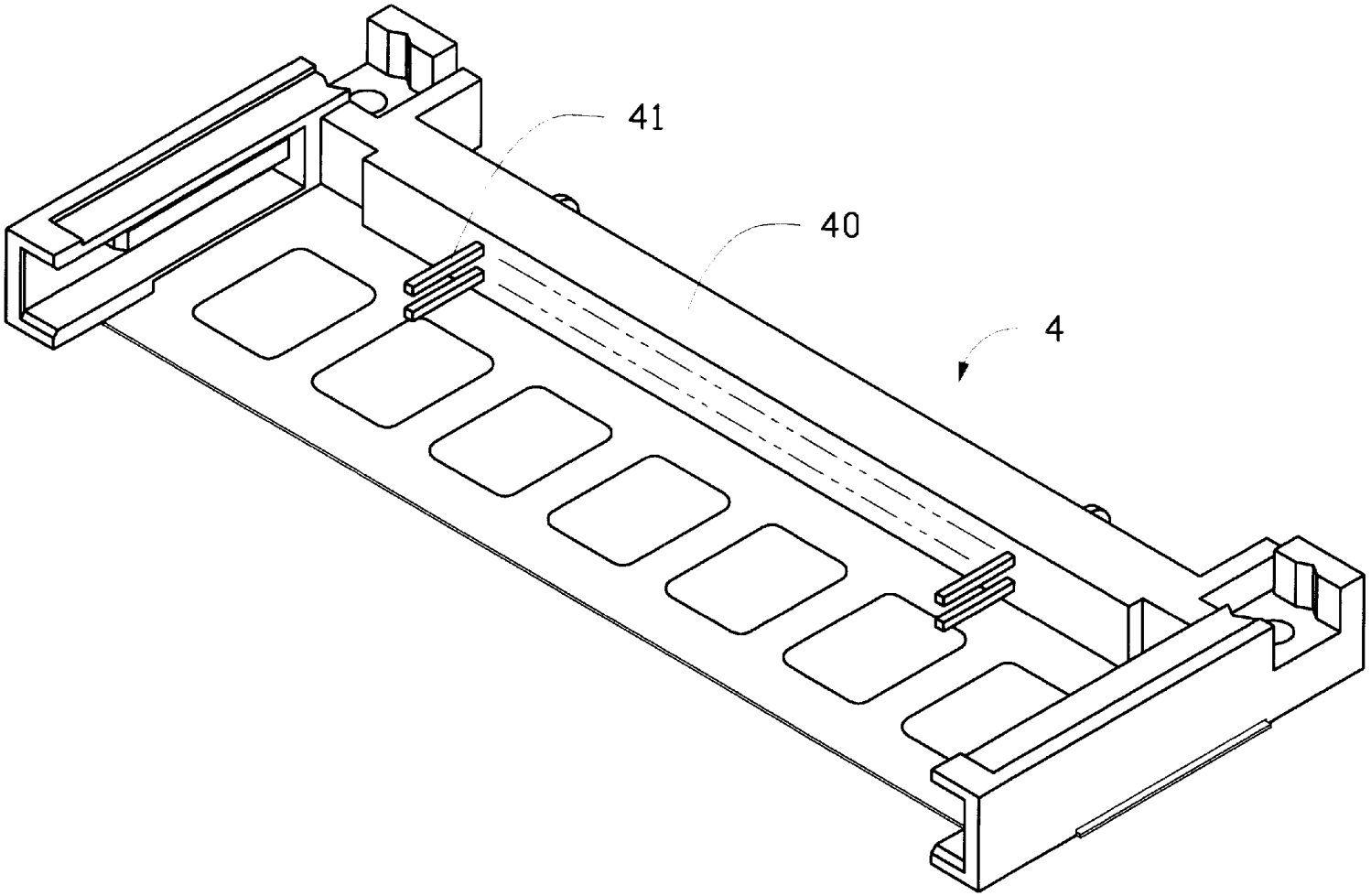
FIG.6 (PRIOR ART)
FIG. 6 is a conventional card connector housing without any auxiliary suction member attached thereto.
Figure 7:
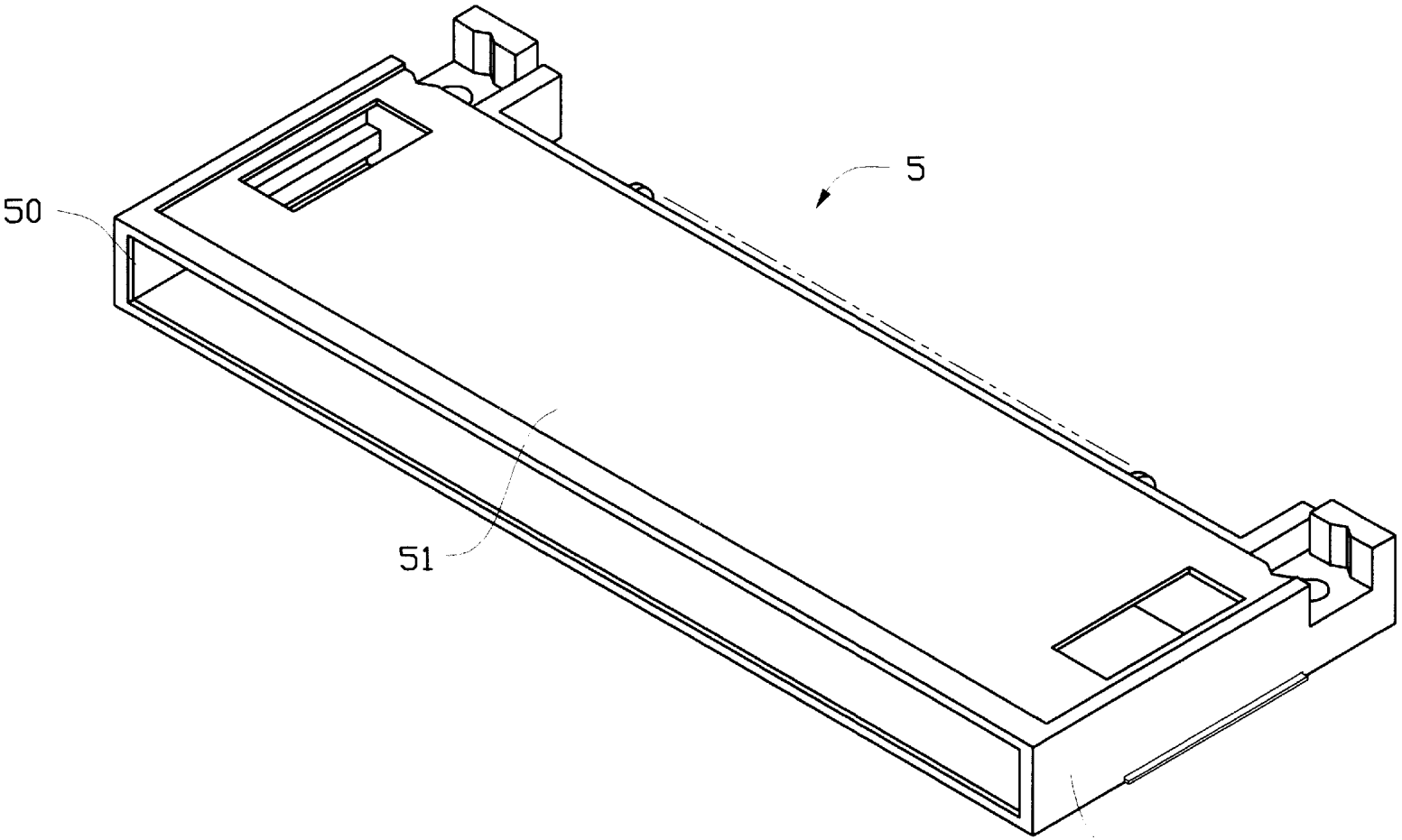
FIG.7 (PRIOR ART)
FIG. 7 is a conventional card connector housing having an auxiliary suction member configured therein.

Referring to FIG. 5, the card connector housing 1 of the present invention is configured with an ejector mechanism 3 for withdrawing a card (not shown) out of the card connector housing 1. The addition of the ejector mechanism 3 will not substantially increase the height of the card connector housing 1. Similarly, if the ejector mechanism 3 is installed onto the conventional card connector housing 5 of FIG. 7, the installation thereof will be laborious and time inefficient. Compared to the conventional card connector housing, this invention has the benefits of compact size, easy installation, and low cost.

It can be understood that the detachable auxiliary suction member 12 is preferably positioned adjacent to a gravity center of the connector 1, and this is the reason why it extends forward from the mating face 101 of the housing 10.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A connector comprising an insulative housing enclosing a plurality of contacts therein, and a detachable auxiliary suction member integrally formed with the housing and extending horizontally toward a gravity center of the connector so as to provide a flat surface for receiving suction from a vacuum nozzle during automated soldering, and to be successively broken away from the housing after soldering.

2. The connector as claimed in claim 1, wherein said contacts extend horizontally below the suction member.

* * * * *